United States Patent [19]

Delery

[11] Patent Number: 4,615,127

[45] Date of Patent: Oct. 7, 1986

[54] SKI BOOT

[75] Inventor: Marc Delery, Caluire, France

[73] Assignee: Compagnie Francaise d'Articles de Sport, Du Pont, France

[21] Appl. No.: 717,866

[22] Filed: Mar. 29, 1985

[30] Foreign Application Priority Data

Apr. 6, 1984 [FR] France ..... 84 05690

[51] Int. Cl.[4] ..... A43B 5/04

[52] U.S. Cl. ..... 36/117; 36/119; 36/121

[58] Field of Search ..... 36/117-121, 36/105, 50

[56] References Cited

U.S. PATENT DOCUMENTS

| | | | |
|---|---|---|---|
| 3,936,959 | 2/1976 | Hanson et al. | 36/119 X |
| 3,945,135 | 3/1976 | Hanson et al. | 36/121 |
| 4,280,286 | 7/1981 | Sartor . | |
| 4,447,970 | 5/1984 | Delery | 36/121 |
| 4,590,691 | 5/1986 | Oliviero . | |

FOREIGN PATENT DOCUMENTS

| | | | |
|---|---|---|---|
| 0073989 | 3/1983 | European Pat. Off. | 36/119 |
| 3045928 | 9/1981 | Fed. Rep. of Germany | 36/117 |
| 2334315 | 7/1977 | France . | |
| 2405665 | 5/1979 | France . | |
| 2545702 | 11/1984 | France | 36/117 |

*Primary Examiner*—James Kee Chi

*Attorney, Agent, or Firm*—Parkhurst & Oliff

[57] ABSTRACT

The present invention relates to a ski boot made of plastics material comprising a shell adapted to receive the foot, wherein the rear part of the shell presents a rigid, flexible portion which follows the shape of the bottom of the rear face of the leg;

and the rear of the boot presents a means adapted to push this rigid, flexible portion towards the front of the shell.

4 Claims, 6 Drawing Figures

SKI BOOT

The present invention relates to a novel type of ski boot, particularly made of plastics material.

Ski boots made of plastic material have been known for several years and it is therefore unnecessary to describe them in detail here.

As is known, in order to obtain a good hold of the foot in a boot, the foot must be held, on the one hand, in a diagonal from the instep to the heel and, on the other hand, in another diagonal from the top of the heel to the plantar arch.

In ski boots made of plastics material, the heel is often not held properly, and this is detrimental to the quality and precision of the skier's action.

In rear-opening ski boots, i.e. boots comprising a spoiler articulated on the shell towards the rear, the hold of the heel is virtually non-existent, unless an additional buckle is added which in practice has proved ineffective as the hold is too high with respect to the heel.

It is an object of the invention to overcome these drawbacks and it relates to a boot made of plastics material in which the heel is held in efficient and economical manner.

This ski boot made of plastics material comprising a shell adapted to receive the foot, is characterized in that:

the rear part of the shell presents a rigid, flexible portion which follows the shape of the bottom of the rear face of the leg;

and the rear of the boot presents a means adapted to push this rigid, flexible portion towards the front of the shell.

Advantageously, in practice:

the rigid, flexible portion which follows the shape of the rear of the bottom of the leg is cleared in the horizontal plane passing through the top of the heel and the swell of the malleoli, and stops to the rear of this swell;

the rigid flexible portion is notched on the top and along the plane of join, in particular in order to avoid rubbing against the Achilles tendon and consequently provoking tendinites;

the boot is of the rearwardly opening type and therefore comprises a rear spoiler articulated on the shell and is characterized in that the means for pushing the rigid flexible portion is fixed on this rear spoiler and passes therethrough, opening out opposite said rigid flexible portion;

the thrust means is constituted by a screw perpendicular to the rear spoiler and which presents:

at its end outside the spoiler a moneuvering head, at its inner end a sectioned piece, mounted idly on this end, which follows the shape of the rear of the leg and is adapted to abut on the rigid flexible portion, the axis of thrust on the rigid flexible portion is at right angles thereto, passes through the bottom of the Achilles tendon and through the zone of swell of the malleoli;

in a simplified version, the thrust means is constituted by a series of elements in relief, integral by moulding, borne on the inner face of the rear spoiler, which consequently, during pivoting/closure of this spoiler, abut against the rigid flexible portion to push the latter towards the front of the foot in contact with the rear face of the leg, in the manner of a cam;

in another version, the thrust means acts on the lateral sides of the rigid flexible portion, and this action is controlled by a transverse screw disposed above the heel; on this screw, with reverse pitch, slide mobile shims abutting on the lateral sides of the rigid portion and thus pushing it forwardly whilst holding it laterally.

The invention will be more readily understood on reading the following description with reference to the accompanying drawings, in which.

Figure 6:
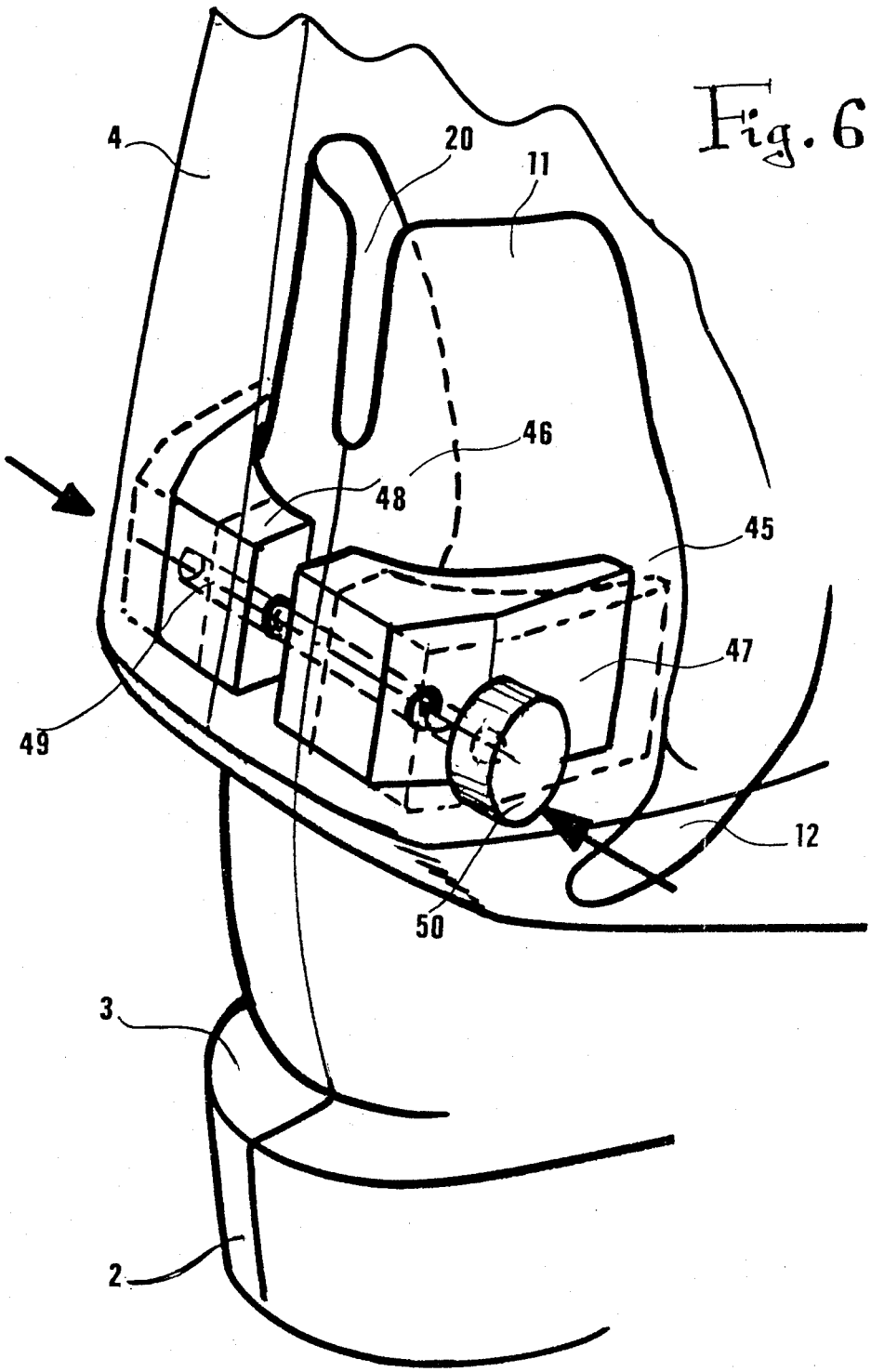

FIG. 6 likewise is a view in section of another embodiment of the invention with lateral hold.

Referring now to the drawings, the ski boot comprises, in known manner, a rigid shell 1 made of injected plastics material such as polyamide or polyurethane, in which is incorporated the sole 2 and the heel element 3. This boot comprises, in known manner, a rear spoiler 4 articulated at 5 on the shell. A front spoiler 6 makes it possible, thanks to a buckle 40, to ensure tightening on the leg 7. The foot 8 is held in the shell by a known device 9.

Figure 4:
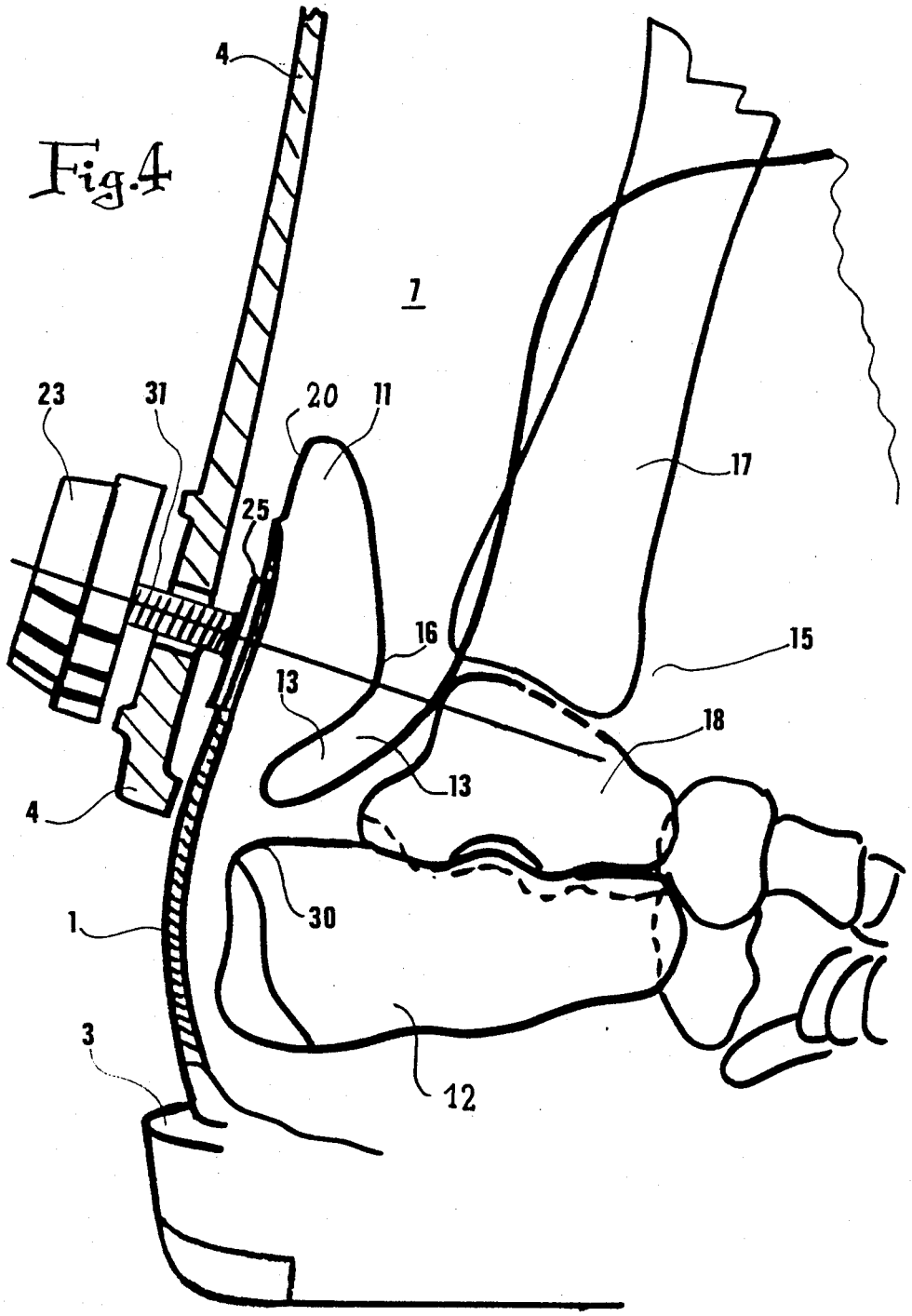
FIG. 4 shows a similar section, in which the anatomy of the foot has been shown.

Furthermore, the rear part 10 of the shell 1 presents, integral by moulding, a rigid flexible portion 11 which follows the shape of the bottom of the rear face of the leg 7 and is articulated in flexible manner on its base for connection 60 at the level of the calcaneum 30 (cf. FIG. 4). This base 60 acts like a hinge for the rigid flexible portion 11. This portion 11 is cleared at 13 in symmetrical manner, in the substantially horizontal plane passing through the top of the calcaneum 30, i.e. in the plane from the top of the heel to the zone of swell 15 of the malleoli. This rigid flexible portion 11 stops at 16 just to the rear of this swell 15.

The tibia 17 of the leg is articulated on the calcaneum 30 of the heel about the astragalus 18.

The top 19 of the rigid flexible portion 11 presents a V-shaped notch 20 disposed along the plane of join 21, so as to avoid friction on the Achilles tendon and consequently tendinites.

Figure 1:
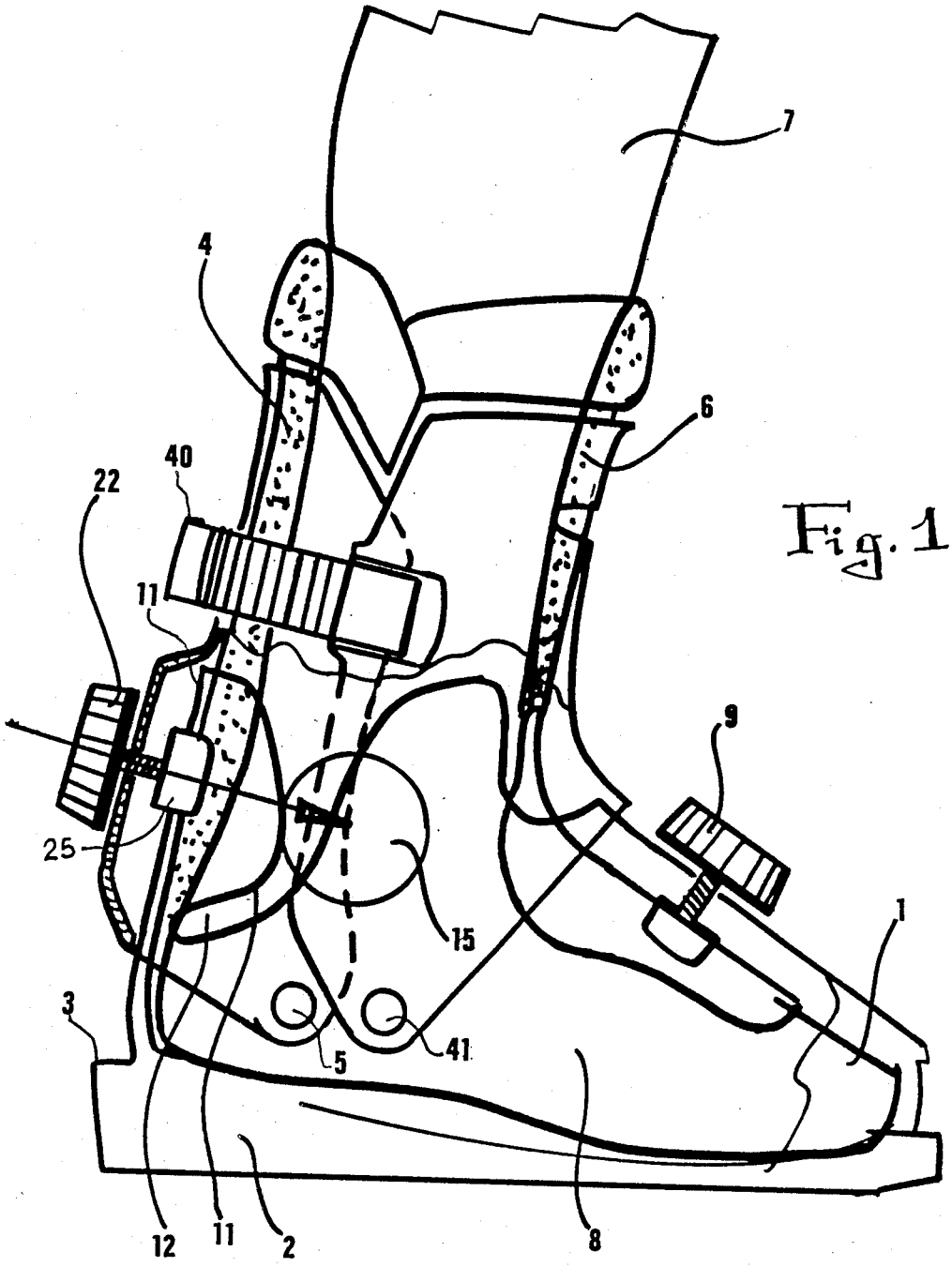
FIG. 1 is a summary schematic view of a ski boot according to the invention.
Figure 2:
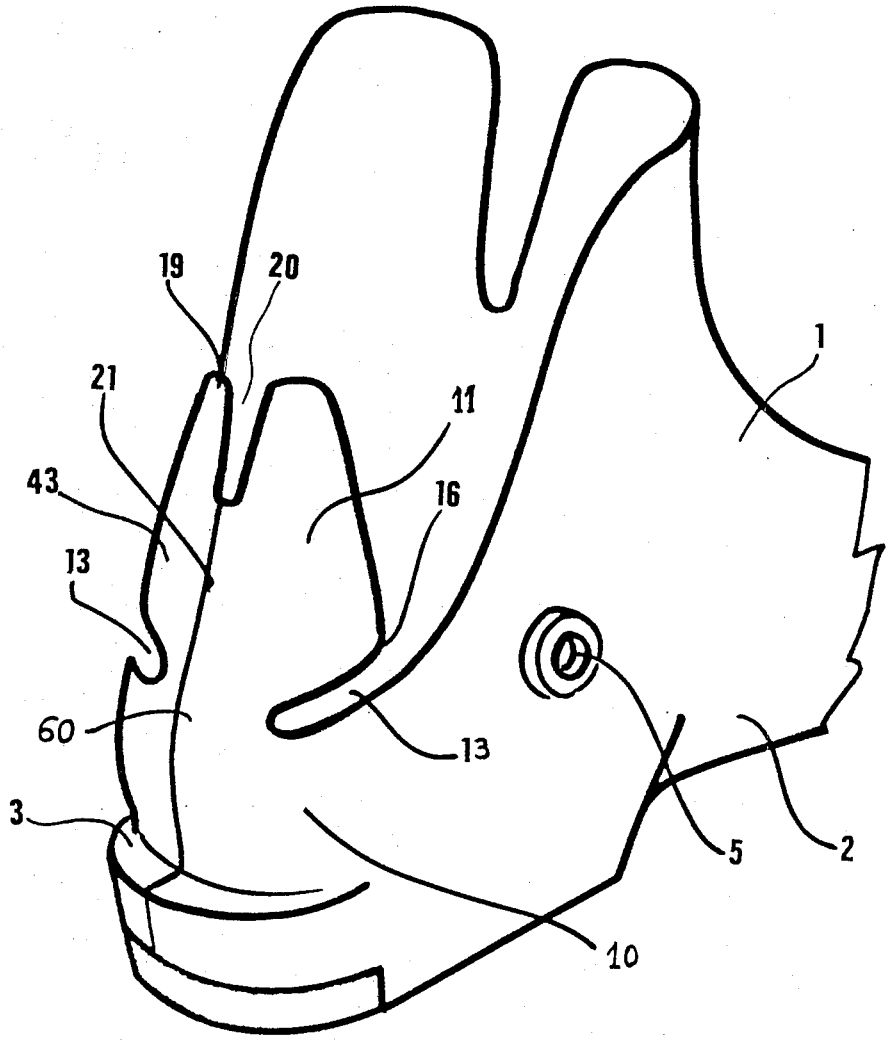
FIG. 2 is a summary three-quarter rear view in perspective of the shell of a ski boot according to the invention.
Figure 3:
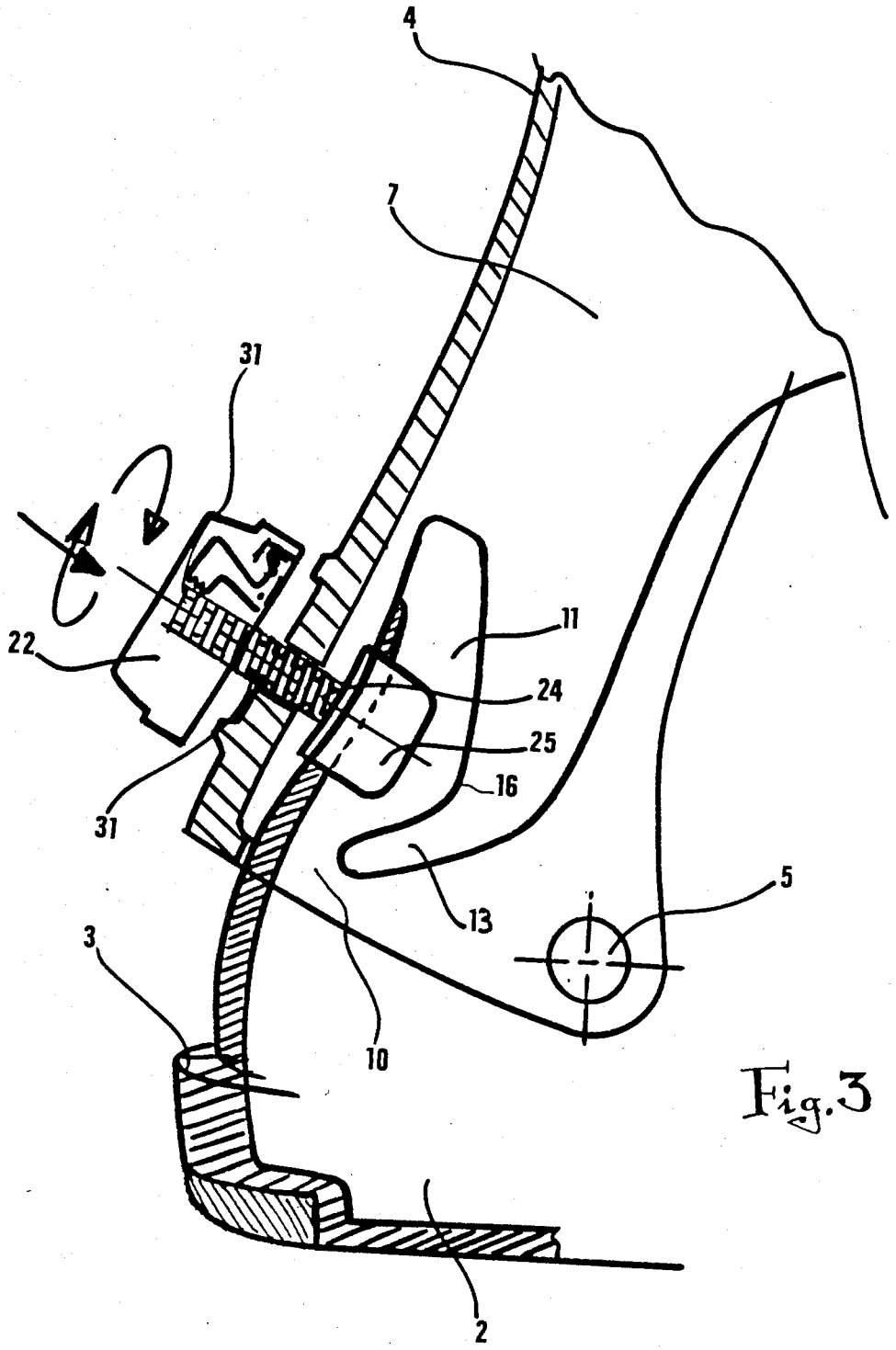
FIG. 3 is a view in section of the rear of such a rearwardly opening boot.

The rear of the rear spoiler 4 presents a thrust means constituted by a screw 31 perpendicular to this rear spoiler 4. The outer end 22 of this screw 31 is fixed on a maneuvering button 23, which is possibly disconnectable. The inner end 24 of this screw 31 is mounted idly on a sectioned piece 25 which follows the shape of the rear of the leg 7. This section 25 abuts on the middle of the rigid flexible portion 11, more precisely substantially at the centre, between 13 and 20 and symmetrically with respect to the plane of join 21. In this way (FIG. 3), by acting via the maneuvering head 23 on the screw 31, as indicated by the arrow, in one direction or in the other, the section 25 is advanced or moved back and consequently the rigid piece 11 is pushed more or less. When the section 25 abuts on the characteristic piece 11, this piece moves forward, along the axis which passes through the top of the calcaneum 30 and the swell 15 of the malleoli (cf. FIG. 4). In this way, the bottom of the leg 7 is applied firmly without abutting on the calcaneum 30. In other words, the heel 12 is held perfectly in the shell 11, without irritating the Achilles tendon (FIG. 4).

The maneuvering head 23 may be disconnectable, as taught in Italian Patent Application No. 19273/84 of Jan. 23, 1984.

It goes without saying that the hardness and the flexibility of the characteristic rigid, flexible portion 11 must be adapted as a function of the application envisaged.

Figure 5:
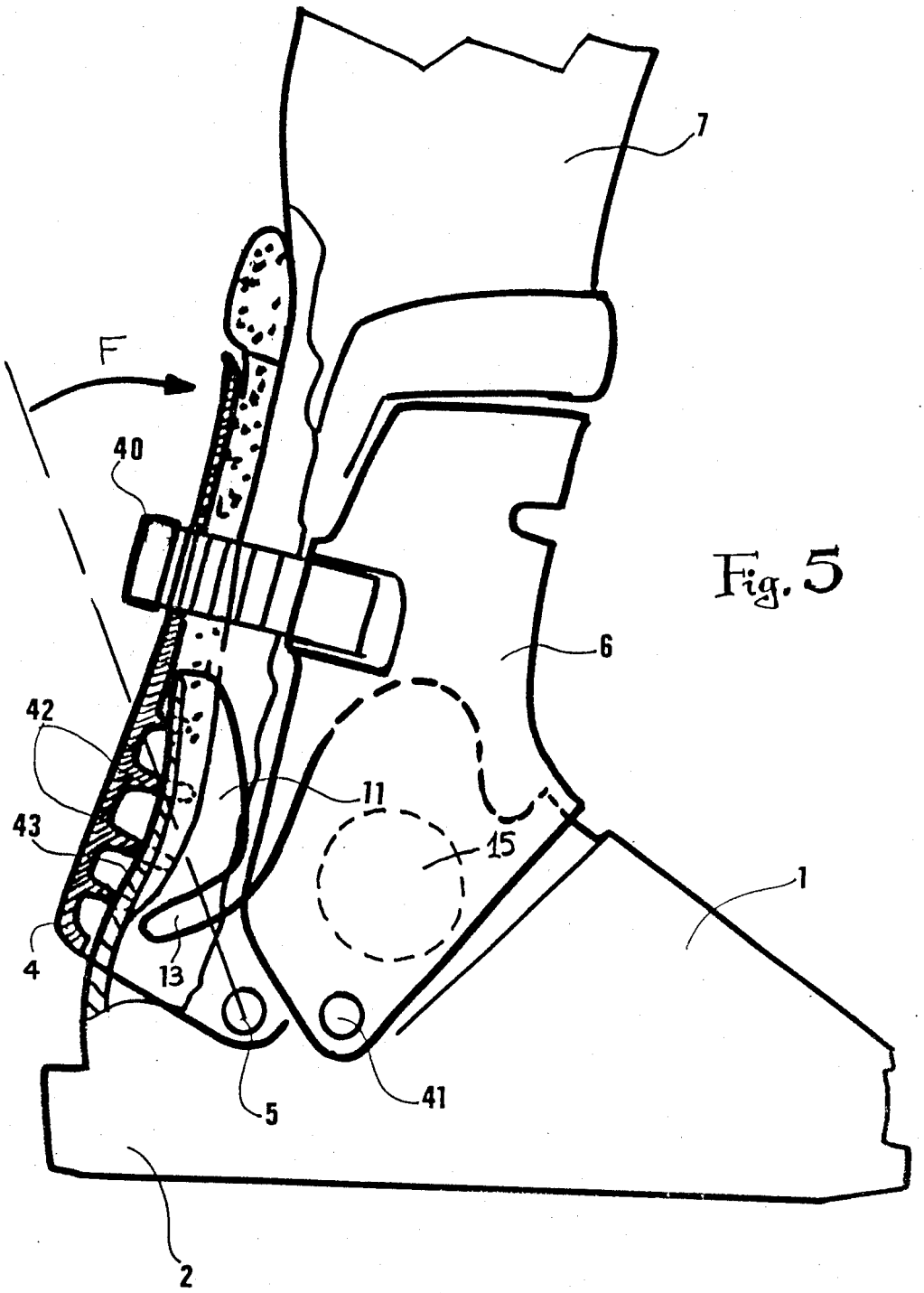
FIG. 5 is a view in section of another simplified version of the invention.

FIG. 5 shows a preferred, simplified embodiment of the invention. This ski boot, which comprises on the shell 1 a front spoiler 6 articulated at 41, and a rear spoiler 4 articulated at 5, is characterized in that the inner face of the bottom of the rear spoiler 4 presents a series of elements in relief 42, integral by moulding, at right angles to the inner face of the spoiler 4; these elements 42 are parallel to one another and project progressively in order to abut on the outer face 42 of the rigid flexible portion 11. In this way, upon pivoting of the rear spoiler 4 about the pivot pin 5, as indicated by arrow F, the front of the elements 42 abuts on the rigid flexible portion 11 and thus deforms it as indicated in FIG. 5 to hold the heel in the boot. A compressible material (foam), which forms a shock absorber, is advantageously interposed between the ends of the elements 42 and the rigid flexible portion 11.

FIG. 6 is another improved embodiment of the invention. Here, the flexible rigid portion 11 is tightened on its two sides 45, 46 by two mobile shims 47, 48 actuated by a screw 49 controlled by a maneuvering button 50. The pitch of the screw 49 is reversed. In this way, under the action of the maneuvering button 50, the two mobile shims, which follow the shape of the rear of the portion 11, abut on the lateral sides 45 and 46 thereof, to tighten this flexible portion 11 and hold the bottom of the leg 7 above the calcaneum 30.

The device according to the invention presents numerous advantages over heretofore known ski boots. This boot, particularly one with rearward opening 4, makes it possible to hold the heel 30 firmly in the shell 1, which was not satisfactorily obtained up to the present time. This precise tightening of the heel is adapted to all morphologies. This ensures improved safety and better skiing.

In addition, the characteristic piece 11 performs the function of a shoe-horn when putting the boot on, for rearwardly opening boots.

What is claimed is:

1. An improved rear-entry ski boot comprising:

a shell adapted to receive a wearer's foot;

rear and front spoilers articulated to said shell; and tightening means;

wherein said shell has an integral rigid flexible portion flexibly articulated to a rear portion of said shell at the level of the wearer's calcaneum, said rigid flexible portion comprising a V-shaped notch disposed at the top of said rigid flexible portion along a plane of join, and two symmetrical clearances in the plane passing through the top of the wearer's calcaneum and the zone of swell of the wearer's malleoli and stopping at the rear of such swell; and further wherein the rear spoiler comprises means for pushing said rigid flexible portion towards the front of the shell.

2. A ski boot according to claim 1, wherein the means for pushing the rigid flexible portion comprises a screw perpendicularly fixed on and passing through the rear spoiler, and opening out opposite said rigid flexible portion, said screw including a maneuvering head on an outer side of the rear spoiler, and a sectioned piece mounted idly on an inner side of the rear spoiler, which sectioned piece follows the shape of the rear of the wearer's leg and which sectioned piece is adapted to abut on the rigid flexible portion.

3. A ski boot according to claim 2, wherein the sectioned piece is adapted to abut on the middle of the rigid flexible portion symmetrically with respect to the plane of join.

4. A ski boot according to claim 1, wherein the means for pushing the rigid flexible portion comprises a series of elements in relief, integral by moulding and borne on the inner side of the rear spoiler, adapted to abut against an outer face of the rigid flexible portion.

* * * * *